United States Patent [19]

Fujiwara et al.

[11] Patent Number: 4,647,189

[45] Date of Patent: Mar. 3, 1987

[54] ELECTROPHOTOGRAPHIC COPYING MACHINE WITH VARIABLE MAGNIFICATION

[75] Inventors: Katsuyoshi Fujiwara, Osaka; Yoshihisa Miwa, Nara; Shoichiro Yoshiura, Yamatokoriyama, all of Japan

[73] Assignee: Sharp Kabushiki Kaisha, Osaka, Japan

[21] Appl. No.: 770,579

[22] Filed: Aug. 29, 1985

[30] Foreign Application Priority Data

Aug. 30, 1984 [JP] Japan ..... 59-183184

[51] Int. Cl.[4] ..... G03G 15/00

[52] U.S. Cl. ..... 355/55; 355/14 R

[58] Field of Search ..... 355/14 R, 14 C, 55–59

[56] References Cited

U.S. PATENT DOCUMENTS 4,575,227 3/1986 Ito et al. ..... 355/14 R

*Primary Examiner*—Richard A. Wintercorn

*Attorney, Agent, or Firm*—Birch, Stewart, Kolasch & Birch

[57] ABSTRACT

An electrophotographic copying machine for determining a variable magnification ratio based upon both automatically sensed copy document size information and manually input copy document size information to eliminate copying errors when copying unformatted sized copy documents onto standard size copy paper.

6 Claims, 5 Drawing Figures

ELECTROPHOTOGRAPHIC COPYING MACHINE WITH VARIABLE MAGNIFICATION

BACKGROUND OF THE INVENTION

This invention relates to an electrophotographic copying machine incorporating a mechanism which computes and selects desired magnification or copy paper size according to detected or input document (text paper) size.

Recently, a wide variety of electrophotographic copying machines with variable magnification, used to perform photocopying by enlarging or reducing document images, have been commercialized. When photocopying with these electrophotographic copying machines, document size, desired magnification and copy paper size must be determined. For this reason, some copying machines incorporate document size detectors in the plate (document table). A plurality of optical sensors are placed under the plate in positions corresponding to the right end of a documents of specific size so that copy paper size matching the maximum sensor position—out of multiple sensors—is defined as the document size. This copying machine incorporates a mechanism which computes and selects a document size upon entry of data on desired magnification or a desired magnification based on entry of data on document size as identified by the said detector and on operator-input magnifications or copy paper size. However, when an unformatted document sized between B5 and A4 is placed on the plate, its right end comes to a point between the B5R and A4 sensors. In this instance, the A4 sensor, but not B5R sensor, detects the document inserted. The document size detector therefore detects the document as if it is of A4 size and photocopies in variable magnifications based on operator-specified magnification or copy paper size. However, since the unformatted document is longer than A4 paper in the exposure scanning direction, copying would allow an enlarged image to overflow the copy paper used, generating waste.

Thus conventional copying machines with variable magnifications equipped with document size detectors generate waste copies when reproducing unformatted or irregular sized documents, thereby substantially lowering operating efficiency.

SUMMARY OF THE INVENTION

The object of the present invention is to provide, in view of these drawbacks, a photocopying machine capable of preventing the production of faulty copies in such a situation and which improves copying machine operating efficiency by incorporating a means for selecting a predetermined variable magnification or suitable magnification when photocopying unformatted documents in variable magnifications.

Other objects and the further scope of applicability of the present invention will become apparent from the detailed description given hereinafter. It should be understood, however, that the detailed description and specific examples, while indicating preferred embodiments of the invention, are given by way of illustration only. Various changes and modifications within the spirit and scope of the invention will become apparent to those skilled in the art after reading this detailed description.

This invention relates to an electrophotographic copying machine characterized by the provision of both an unformatted document identification key used to photocopy irregularly-sized documents and an unformatted document entry function, which allows such a document to be input after key operation, and by incorporating a mechanism which computes and selects a desired magnification or copy paper size using input information entered via said input device.

BRIEF DESCRIPTION OF THE DRAWINGS

The present invention will be better understood from the detailed description given hereinafter and the accompanying drawings, given by way of illustration only, which are not limitative of the present invention.

DESCRIPTION OF THE INVENTION

Figure 2:
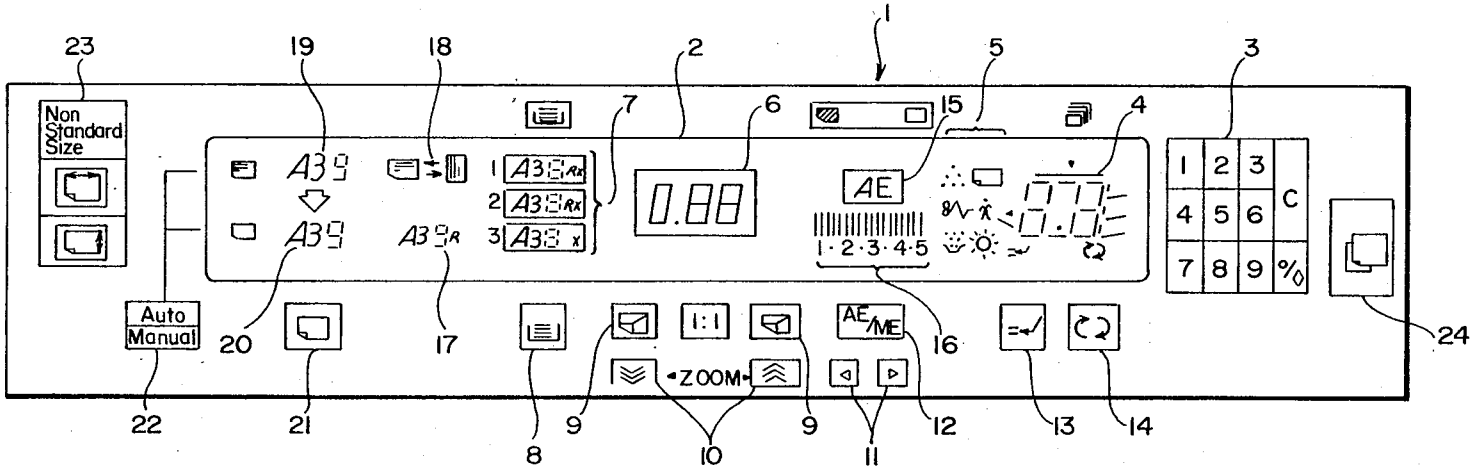
FIG. 2 is a diagrammatic illustration of its control unit.

FIG. 2 illustrates the control unit of the copying machine embodying the present invention.

An indicator (2) is located near the center of the control unit (1). A numeric key (3) and COPY button (24) are located to the right of indicator (2). A numeric indicator (4), to the right of indicator (2), shows the number of copies to be reproduced as input from numeric key (3), or unformatted document size. Beneath the numeric indicator an interrupt key (13) and a repeat key (14) are found. A warning indicator (5) to the left of numeric indicator (4) alerts the operator of the need for toner refill or machine jamming by means of schematic illustration. An exposure indicator (16) indicates exposure density controlled by exposure control key (11), located below the indicator. An automatic exposure indicator (15) indicates the automatic exposure value selected using automatic exposure selection key (12). A variable magnification indicator (6), located near the center of indicator (2), indicates variable magnification values input from variable magnification selection key (9) and zoom key (10). A cassette-sized indicator (7) shows the size of copy paper housed in each of the cassettes installed in three stacks within the paper feed unit of the copying machine (not shown). A cassette selection key (8) located beneath indicator (7) indicates the selected cassette. A document size indicator (19) to the left of indicator (2) indicates document size as identified by the document size detector or input by the operator. A copy size indicator (20) indicates input magnification and copy paper size computed from the document size or selected using copy size selection key (21) beneath indicator (20). A photocopy paper size indicator (17) indicates the copy paper cassette size computed from document size and desired magnification when such cassette is not mounted. A document position indicator (18) tells the operator to change incorrect document orientation on the plate if improperly oriented or not suitable for predetermined magnification or copy paper size. An automatic copy paper/magnification selector key (22) is pressed when data on copy paper size and desired magnification is entered manually. An unformatted document mode key (23) invalidates, upon copying unformatted (irregular sized) documents, specific magnifications or copy paper size computed by means of identified document size. A lateral input key (25) and longitudinal input key (26) underneath are operated when data on unformatted document size is entered via numeric key (3).

Figure 3:
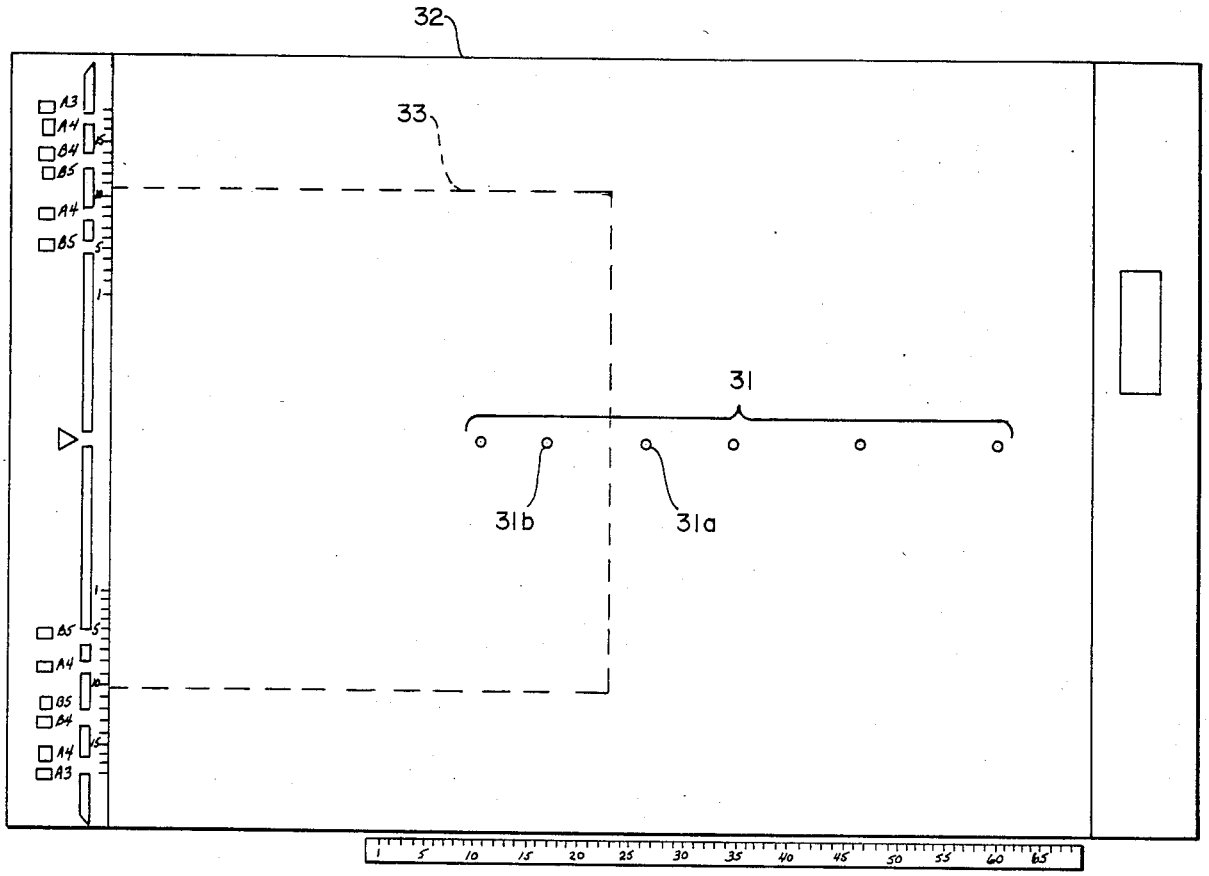
FIG. 3 illustrates a platen provided with a document size detector.

As shown in FIG. 3, the document size detector in the copying machine consists of a plurality of optical sensors (31) located under the plate. Each sensor (31) position corresponds to the right end of a specific-size document placed on the plate, so that copy paper size matching the maximum sensor position—out of multiple sensors—is defined as the document size. This copying machine incorporates a mechanism which computes and selects document size on entry of data on desired magnification, or a desired magnification based on entry of data on document size as identified by the said detector and on operator-input magnification or copy paper size.

However, the detector itself (FIG. 3) has no direct bearing on the essential point of this invention.

Figure 4:
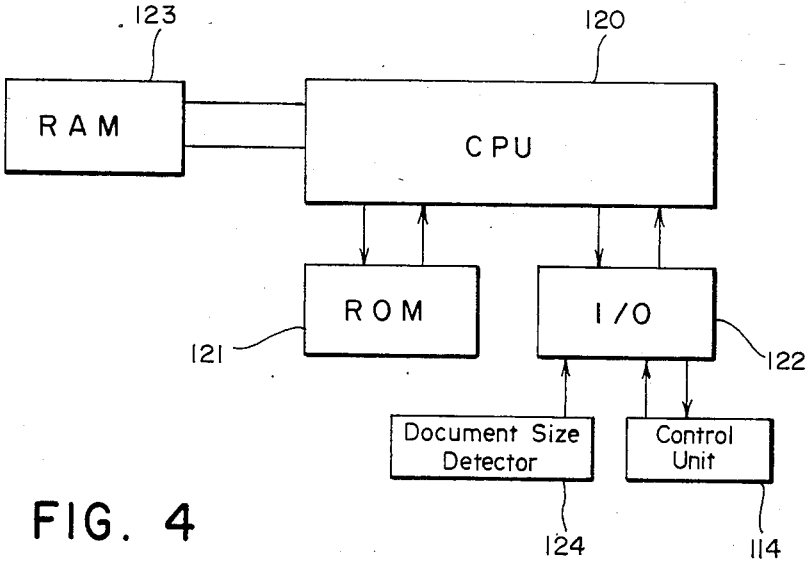
FIG. 4 is a block diagram of the electrophotographic copying machine circuitry.

FIG. 4 is a block diagram of the copying machine embodying this invention, equipped with the unformatted document size invalidating function.

The CPU (120) is connected, via an internal bus, to ROM (121), which stores the programs that control the various functions of the copying machine and data on usable formatted paper sizes; I/O (122) is linked with control unit (114) and the document (124) on the plate and to RAM (123), which stores both I/O (122) input signals and computation results.

The document size detector (124) corresponds to the device in FIG. 3 and its control unit (114) in FIG. 4.

Figure 1A:
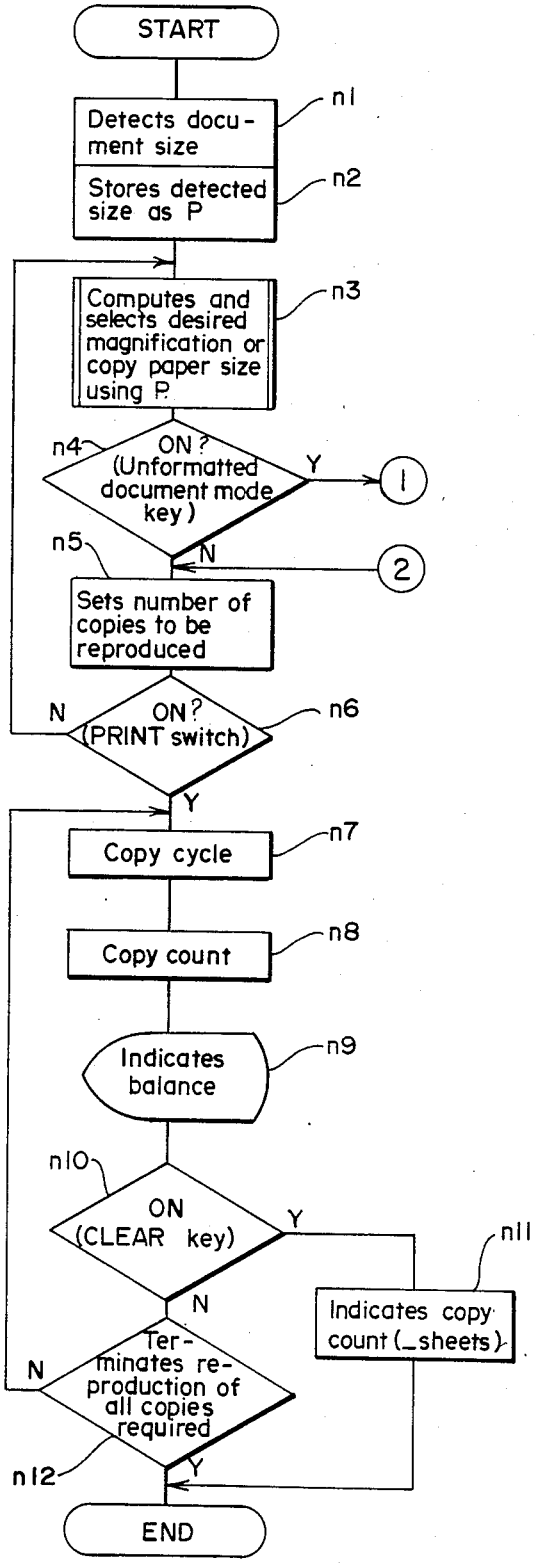
FIGS. 1(A) and (B) are flow charts which illustrate the operation of the electrophotographic copying machine embodying the present invention.
Figure 1B:
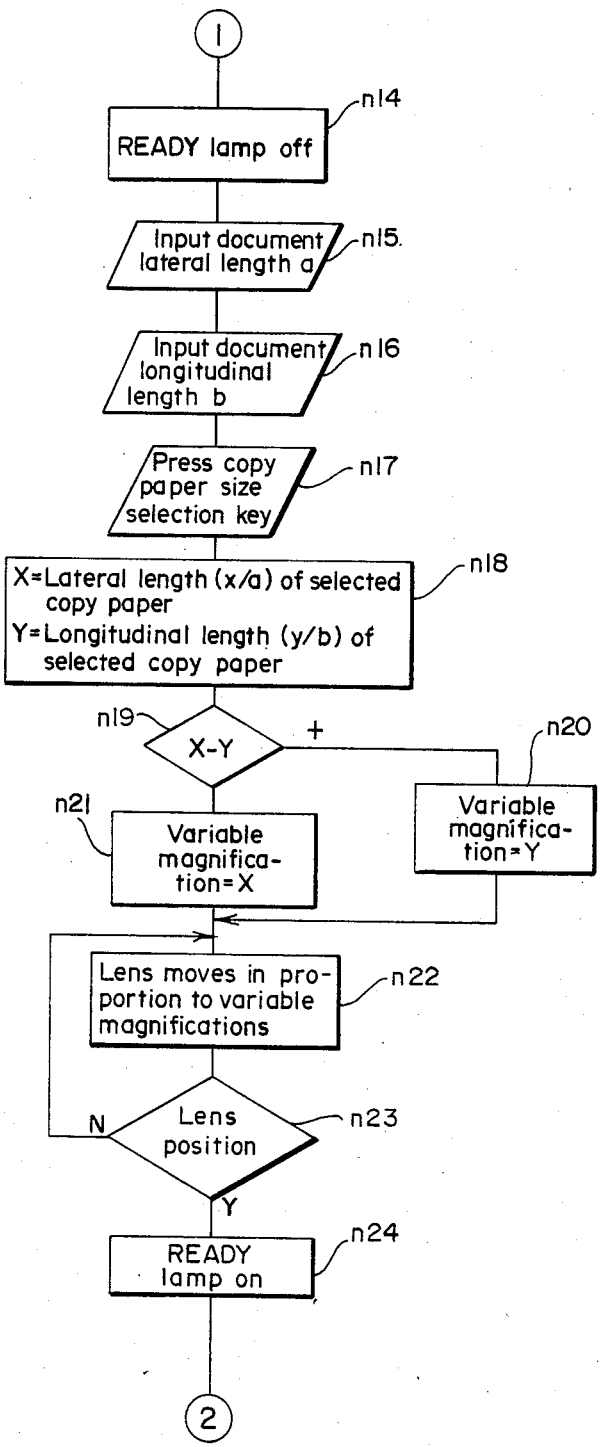

FIGS. 1 (A) and (B) show the operation of the electrophotographic copying machine with variable magnification.

After a document is placed on the plate, the size of this document is detected by the document size detector (FIG. 3) at step n1 (hereafter referred to as "n1"). Next, size P, detected in n2, is stored in RAM (123), and at n3, copy paper size is computed and selected on the basis of the document size and existing variable magnification. At n4, the detector determines if an unformatted document mode key was depressed. If not, control moves on to n5, where the number of copies to be reproduced is set via numeric key (3). The machine then determines if PRINT button (24) was depressed; if not, control returns to n3. When the PRINT button (24) is pressed at n6, control moves on to n7 and initiates the copying cycle. Each time the copying cycle terminates at n8, the number of copies reproduced are deducted from the initial count and the balance is indicated at n9. At n10, the machine determines if the CLEAR key was pressed; if not, the machine determines if the copying cycle or all copies to be reproduced has been terminated at n12. If not completed at n12, control returns to n7 to repeat the copying cycle. If the CLEAR key is pressed at n10 or if the copying cycle for all copies to be reproduced has been terminated at n12, document reproduction stops.

If the unformatted document mode key was pressed at n4, the machine performs computations using the document size P, stores copy paper size and turns off the READY lamp at n14. Control then moves on to n15 and n16, where the lateral length A and longitudinal length B of an unformatted document are stored in RAM (123) by means of the lateral input key (25), longitudinal input key (26) and numeric key (3). At n17, depression of a copy paper size selection key (21) enables selection of copy paper size. Later, at n18, computation of ratios (X and Y) of lateral and longitudinal lengths of the unformatted document and copy paper are made on the basis of data stored in RAM (123); a comparison is made of the two ratios (X) and (Y) at n19. If lateral ratio (Y) is greater, control moves on to n20; if longitudinal ratio (X) is greater, control moves on to n21. In other words, the smaller longitudinal and lateral ratios in n19, n20 and n21 are selected as variable magnifications. Then, at n22 and n23, the lens is moved to a position where variable magnifications obtained can be executed. When lens transfer has been completed at n23, READY lamp goes on at n24 and control returns to n5.

A series of these operations make it possible to store, when copying unformatted documents, variable magnifications or copy paper sizes computed and selected with the aid of detected document sizes and allows high priority for a photocopying operation using desired magnifications as computed from document and copy paper sizes, which are manually input by an operator.

The operation is designed to compute desired magnifications from the size of unformatted documents input by an operator and predetermined copy paper sizes. Similarly, it is also possible to compute image expandability and select adequate copy paper size based on the size of manually input unformatted document size and predetermined magnifications.

The system configuration embodied in the present invention enables, when copying unformatted documents, the selection of a copy paper size or a desired magnification adapted to the size of document to be copied, thereby preventing waste resulting from faulty reproduction of unformatted documents and concurrently improving copying machine operating efficiency.

While only certain embodiments of the present invention have been described, it will be apparent to those skilled in the art that various changes and modifications may be made therein without departing from the spirit and scope of the present invention as claimed.

What is claimed is:

1. An electrophotographic copying machine having a document table for supporting a document to be copied, comprising:

automatic document size detection means for detecting the lateral and longitudinal lengths of a copy document placed on the document table;

memory means for storing the lateral and longitudinal lengths detected by said detection means;

means for computing and selecting a standard copy paper size according to said detected lateral and longitudinal lengths of a copy document and according to a predetermined magnification ratio;

manual mode selection means for selecting an unformatted document mode when said copy document is of a non-standard size;

means for manually inputting the lateral and longitudinal lengths of said copy document in said unformatted document mode, said manually input lengths being stored in said memory means;

means for manually selecting a desired standard copy paper size for use in said unformatted document mode; and means for determining a variable magnification ratio in said unformatted document mode according to said lateral and longitudinal length obtained from both of said automatic document size detection means and said means for manually inputting as stored in said memory means.

2. An electrophotographic copying machine according to claim 1, wherein said means for determining a variable magnification ratio in said unformatted document mode includes, means for calculating a lateral magnification ratio by dividing said automatically detected lateral length by said manually input lateral document length, means for calculating a longitudinal magnification ratio by dividing said automatically detected longitudinal length by said manually input longitudinal document length, and means for subtracting the thus calculated longitudinal magnification ratio from said lateral magnification ratio to obtain a numerical variable magnification ratio.

3. An electrophotographic copying machine according to claim 1, wherein said automatic document size detection means includes a plurality of sensors located beneath said document plate and corresponding to a plurality of standard copy paper size.

4. An electrophotographic copying machine according to claim 2, wherein said numerical variable magnification ratio is either positive or negative, said positive ratio being selected for providing a variable magnification ratio based on said longitudinal magnification ratio and said negative ratio being selected for providing a variable magnification ratio based on said lateral magnification ratio.

5. A method for selecting a variable magnification and copy paper size in an electrophotographic copying machine having a document table for supporting a document to be copied comprising the steps of:

(a) automatically detecting the lateral and longitudinal lengths of a copy document placed on the document table;

(b) computing said selecting a standard copy paper size according to said detected lateral and longitudinal lengths of a copy document and according to a predetermined magnification ratio;

(c) selecting an unformatted document mode when said copy document is of a non-standard size;

(d) manually inputting the lateral and longitudinal lengths of said copy document in said unformatted document mode;

(e) manually selecting a desired standard copy paper size for use in said unformatted document mode; and (f) determining a variable magnification ratio in said unformatted document mode according to the lateral and longitudinal lengths detected by said step (a) of automatically detecting and the lateral and longitudinal lengths input by said step (d) of manually inputting the lateral and longitudinal lengths of said copy document in said unformatted document mode.

6. The method of claim 5, wherein the step of determining a variable magnification ratio in said unformatted document mode includes the steps of, (a) calculating a lateral magnification ratio by dividing said automatically detected lateral length by said manually input lateral document length;

(b) calculating a longitudinal magnification ratio by dividing said automatically detected longitudinal length by said manually input longitudinal document length, and (c) subtracting the thus calculated longitudinal magnification ratio from said lateral magnification ratio to obtain a numerical variable magnification ratio.

* * * * *